United States Patent [19]

Simko et al.

[11] 4,240,395

[45] Dec. 23, 1980

[54] AIR/FUEL RATIO CONTROLLER

[75] Inventors: Aladar O. Simko, Dearborn Heights; Michael M. Schechter, Southfield, both of Mich.

[73] Assignee: Ford Motor Company, Dearborn, Mich.

[21] Appl. No.: 937,693

[22] Filed: Aug. 29, 1978

[51] Int. Cl.[3] ..... F02D 1/14; F02M 25/06

[52] U.S. Cl. ..... 123/445; 123/382; 123/568

[58] Field of Search .... 123/119 A, 140 MP, 140 MC, 123/139 BG

[56] References Cited

U.S. PATENT DOCUMENTS

| | | | |
|---|---|---|---|
| 2,486,816 | 11/1949 | Beeh | 123/140 MC |
| 2,914,050 | 11/1959 | Reggio | 123/140 MC |
| 2,989,043 | 6/1961 | Reggio | 123/140 MC |
| 3,906,909 | 9/1975 | Garcea | 123/119 A |
| 3,963,011 | 6/1976 | Saito | 123/119 A |
| 4,009,700 | 3/1977 | Engels | 123/119 A |
| 4,108,122 | 8/1978 | Barnard | 123/119 A |
| 4,137,879 | 2/1979 | Kageyama | 123/119 A |

FOREIGN PATENT DOCUMENTS

| | | | |
|---|---|---|---|
| 414580 | 8/1946 | Italy | 123/140 MC |
| 538229 | 7/1941 | United Kingdom | 123/140 MC |

*Primary Examiner*—Charles J. Myhre
*Assistant Examiner*—Carl Stuart Miller
*Attorney, Agent, or Firm*—Robert E. McCollum; Clifford L. Sadler

[57] ABSTRACT

An internal combustion engine has a fuel injection pump and an air/fuel ratio controller. The controller has a lever that is connected to the pump lever. An aneroid moves the controller lever as a function of changes in intake manifold vacuum to maintain a constant air/fuel ratio to the mixture charge. A fuel enrichment linkage is provided that modifies the movement of the fuel flow control lever by the aneroid in response to changes in manifold gas temperature levels and exhaust gas recirculation to maintain the constant air/fuel ratio. A manual override is provided to obtain a richer air/fuel ratio for maximum acceleration.

23 Claims, 8 Drawing Figures

AIR/FUEL RATIO CONTROLLER

This invention relates in general to a fuel injection system. More particularly, it relates to a mechanism for controlling the air/fuel ratio of the mixture charge delivered to the combustion chamber of an internal combustion engine.

U.S. Pat. No. 3,696,798, Bishop et al, shows and describes a combustion process for a fuel injection type internal combustion engine in which the air/fuel ratio of the mixture charge is maintained constant during engine idle and part throttle operating conditions, for emission control and improved fuel economy. This constant air/fuel ratio is maintained even though exhaust gas recirculation (EGR) is used to control the $No_x$ level by reducing the maximum combustion chamber temperature and pressure.

Copending U.S. Pat. application Ser. No. 928,213, Fuel Injection Pump Assembly, filed July 26, 1978, shows and describes a fuel injection pump having a face cam pumping member that is contoured to provide a fuel flow output that varies with engine speed in a manner to match mass air flow changes over the entire engine speed and load operating range to provide a constant air/fuel ratio.

This invention is directed to an air/fuel ratio controller that provides the mechanism to maintain the constant air/fuel ratio described in connection with the above two devices regardless of changes in engine manifold vacuum, intake manifold gas temperature, and the flow of exhaust gases to control $No_x$ levels. Therefore, it is an object of this invention to provide a controller that will automatically maintain a constant air/fuel ratio to a mixture charge flowing into the engine combustion chambers by changing the fuel flow output of the injection pump of the type described above as a function of changes in intake manifold vacuum upon opening of the engine throttle valve upon a depression of the conventional vehicle accelerator pedal. Since the addition of exhaust gases to the intake mixture charge will decrease the oxygen concentration of the charge flowing to the combustion chamber, the fuel flow from the injection pump is further modified to change as a function of EGR gas flow to maintain the constant air/fuel ratio desired. The fuel pump fuel output is also modified as a function of intake manifold gas temperature or density.

Fuel injection pump assemblies are known that attempt to automatically maintain some kind of air/fuel ratio control in response to changes in air temperature and air pressure as well as exhaust backpressure. For example, U.S. Pat. No. 2,486,816, Beeh, Fuel Mixture Control for Internal Combustion Engines, shows in FIG. 10 a control system for two fuel injection pumps in which the fuel flow output is varied as a function of changes in engine intake manifold vacuum level, manual settings, and intake temperature and exhaust pressure levels. U.S. Pat. No. 2,989,043, Reggio, Fuel Control System, shows in FIG. 6 a mechanical-vacuum system in which a particular fuel/air ratio is chosen by movement of a manual lever 78, that ratio being maintained even though changes occur in air temperature and manifold vacuum levels. FIG. 10 shows the use of such a system with a fuel injection pump 104.

Neither of the above devices, however, operates to maintain the same constant air/fuel ratio over the entire operating load range of the engine, and neither shows any control at all for modifying the fuel output to compensate for the addition of exhaust gases to control $No_x$ levels.

Therefore, it is a primary object of this invention to provide an air/fuel ratio controller that operates over the major portion of the engine speed and load operating range to maintain a constant ratio to the air and fuel in the mixture charge flowing to the engine combustion chambers regardless of changes in intake charge temperature or variations in air flow proportions caused by the substitution of exhaust gases for air during part of the operating range of the engine.

It is another object of the invention to provide a mechanical-vacuum linkage that automatically changes the fuel injection pump fuel output in response to engine intake manifold vacuum changes upon opening of the vehicle throttle valve so as to maintain a constant air/fuel ratio to satisfy the combustion process of U.S. Pat. No. 3,696,798, for example, and to modify the fuel output when exhaust gases displace air in the intake charge, and to further modify the fuel output by manually overriding the constant air/fuel ratio controlling mechanism to provide maximum enrichment or maximum fuel output when wide open throttle accelerating conditions of the vehicle are required.

Other objects, features and advantages of the invention will become more apparent upon reference to the succeeding detailed description thereof, and to the drawings illustrating the preferred embodiment thereof; wherein, FIG. 1 is a schematic representation of an internal combustion engine fuel injection system having an air/fuel ratio controller embodying the invention;

Figure 2:
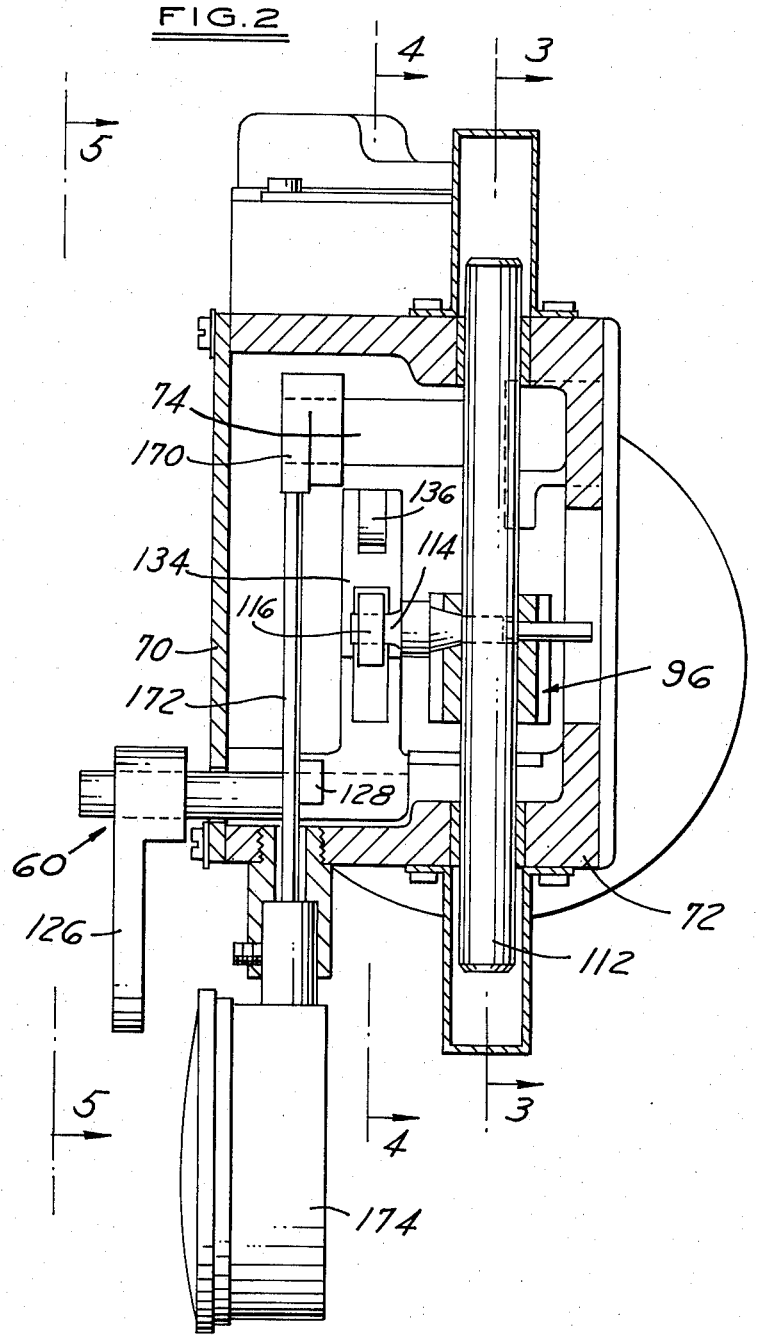
FIGS. 2 and 5 are enlarged end and side elevational views, respectively, of the air/fuel ratio controller shown in FIG. 1, with the covers removed to expose the internal mechanism.
Figure 3:
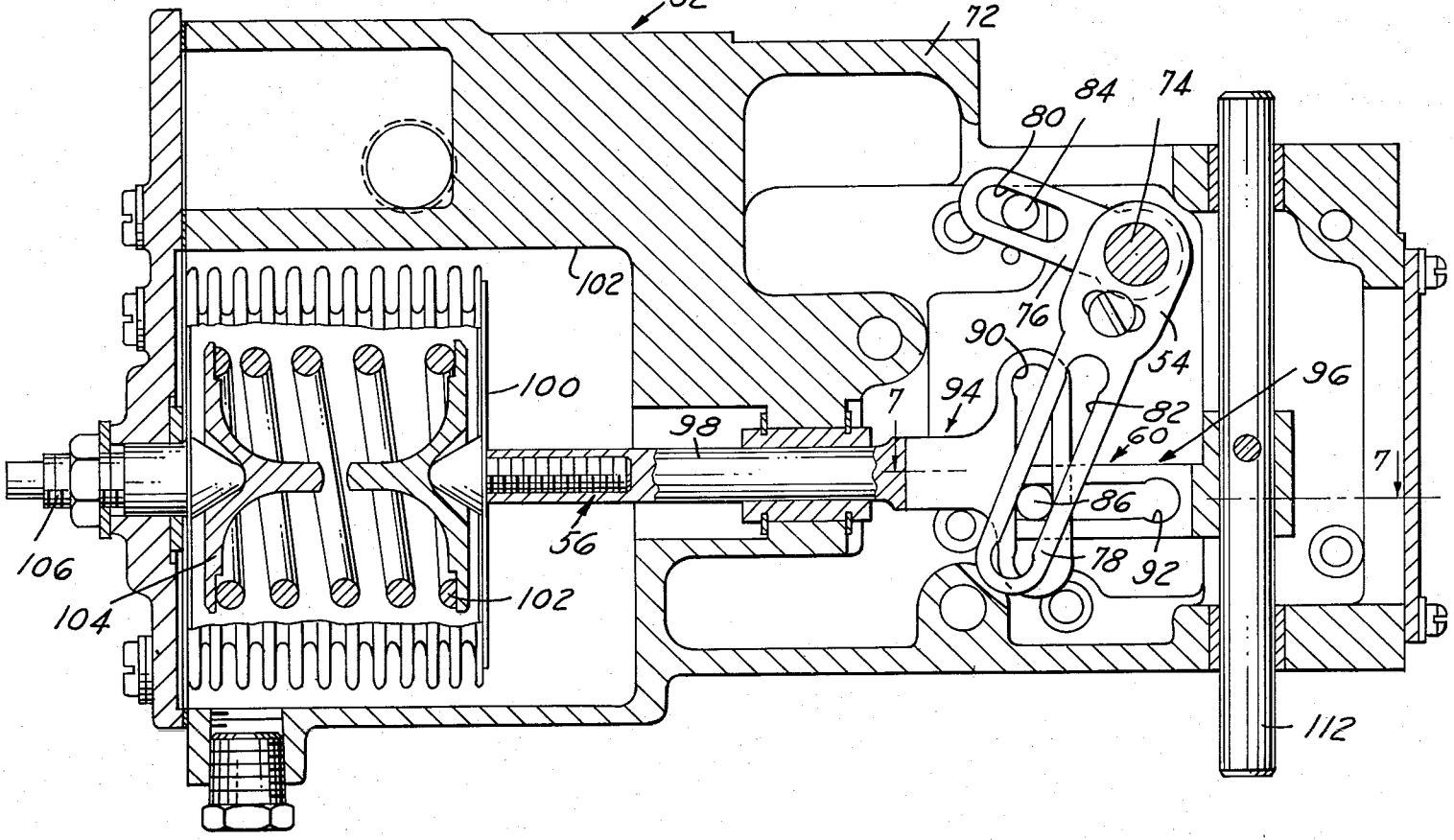
FIG. 3 is a cross-sectional view taken on a plane indicated by and viewed in the direction of the arrows 3—3 of FIG. 2.
Figure 7:
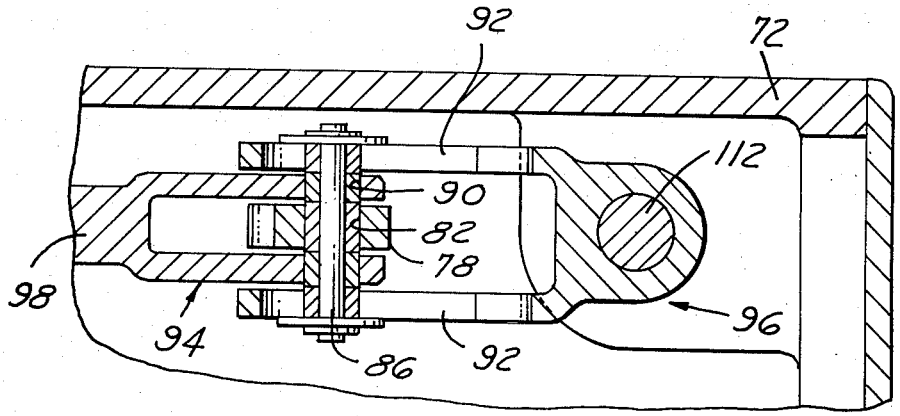
Figure 4:
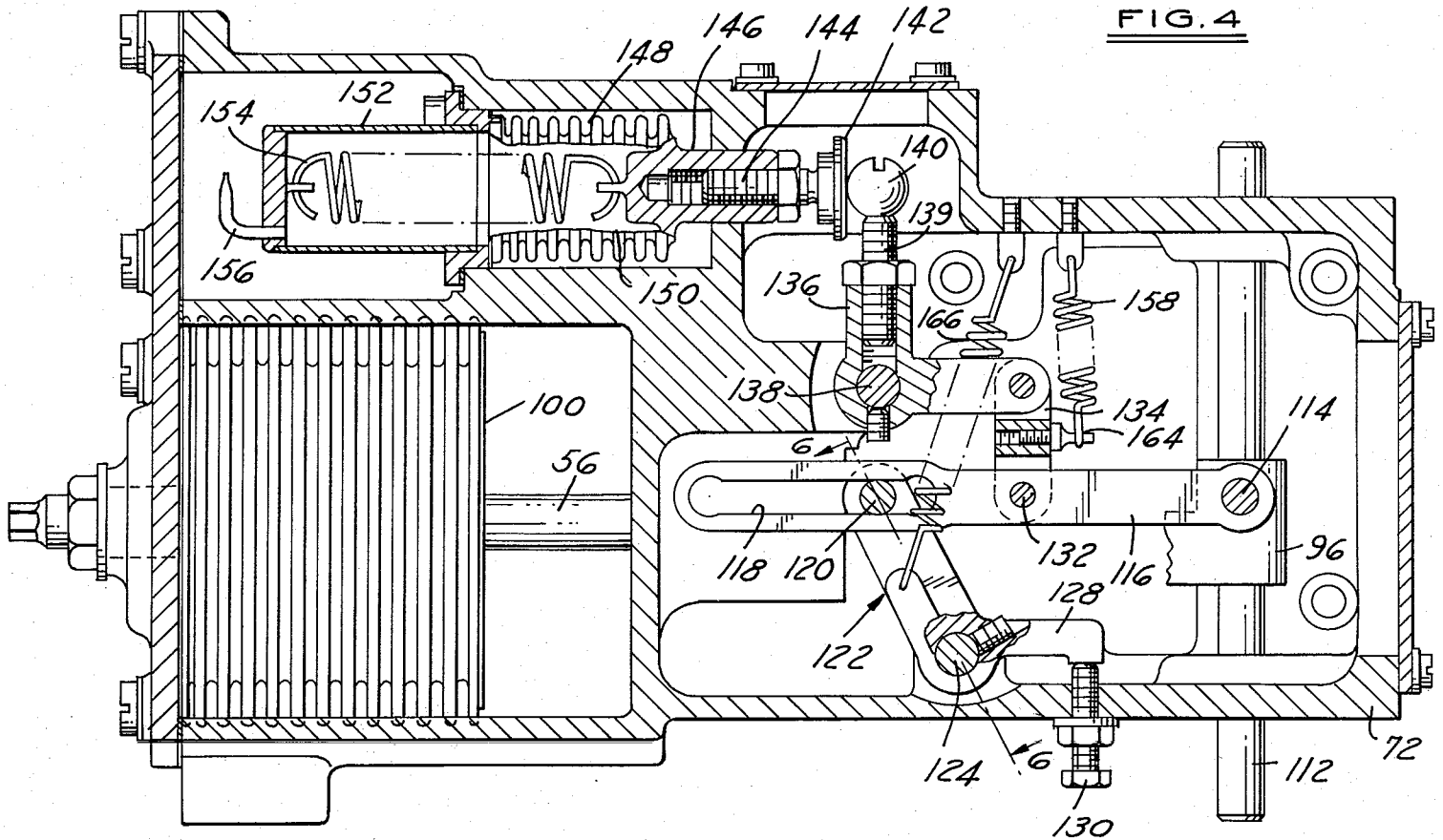
Figures 5, 6:
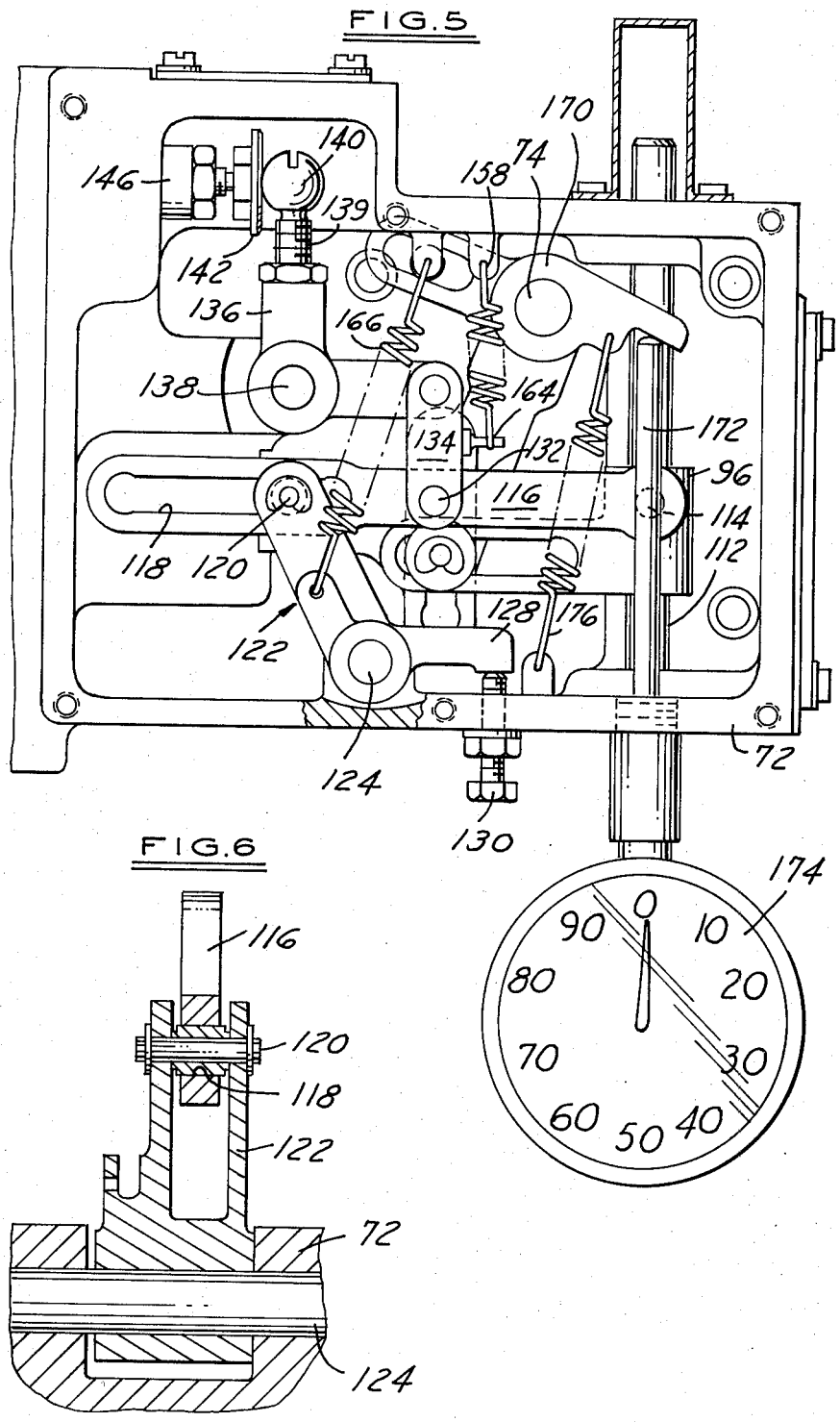

FIG. 4 is a cross-sectional view taken on a plane indicated by and viewed in the direction of the arrows 4—4 of FIG. 2; and FIGS. 6 and 7 are enlarged cross-sectional views taken on planes indicated by and viewed in the direction of the arrows 6—6 and 7—7 of FIGS. 4 and 3, respectively.

Figure 1:
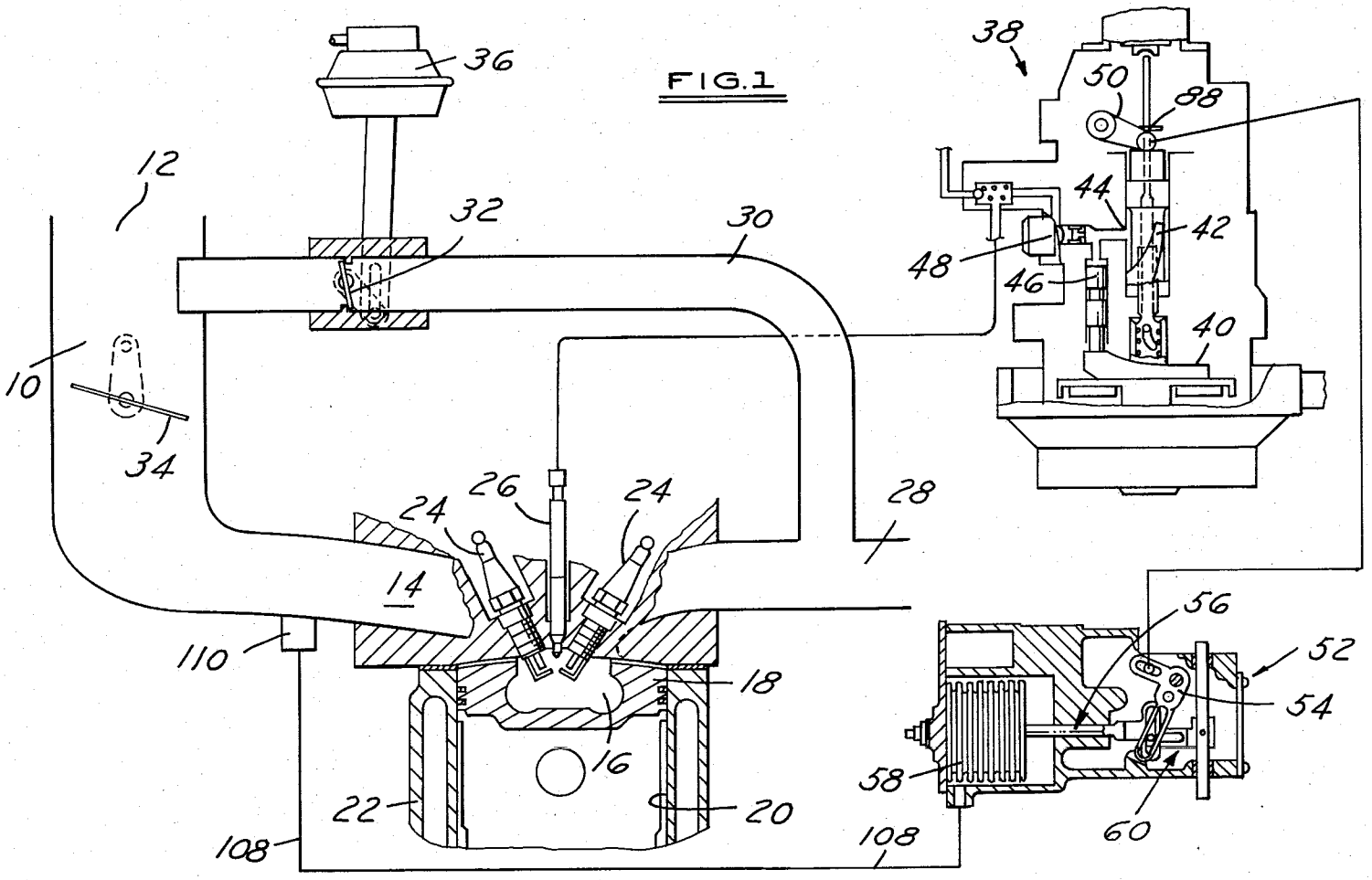

FIG. 1 illustrates schematically a portion of the induction and exhaust system of a fuel injection type internal combustion engine in which is incorporated the air/fuel (A/F) ratio controller of this invention.

More specifically, the system includes an air-gas intake manifold induction passage 10 that is open at one end 12 to air at essentially atmospheric or ambient pressure level and is connected at its opposite end 14 to discharge through valving not shown into a swirl type combustion chamber indicated schematically at 16. The chamber in this case is formed in the top of a piston 18 slidably mounted in the bore 20 of a cylinder block 222. The chamber has a pair of spark plugs 24 for the ignition of the intake mixture charge from the induction passage 14 and the fuel injected from an injector 26 providing a locally rich mixture and overall lean cylinder charge. An exhaust gas conduit 28 is connected to a passage 30 that recirculates a portion of the exhaust gases past an EGR valve 32 to a point near the inlet to the induction passage 10 and above the closed position of a conventional throttle valve 34. Thus, movement of the throttle valve 34 provides the total control of the mass flow of gas (air plus EGR) into the engine cylinder. The EGR valve 32 is rotatable by a servo mechanism 36 connected by means not shown to the throttle valve 34 to provide a flow of exhaust gases during the load conditions of operation of the engine.

The fuel in this case delivered to injector 26 is provided by a fuel injection pump 38 of the plunger type shown and described more fully in application U.S. Ser. No. 928,213 referred to above. The details of construction and operation of the pump are fully described in the above U.S. Ser. No. 928,213 and, therefore, are not repeated since they are believed to be unnecessary for an understanding of the invention. Suffice it to say, however, that the pump has a cam face 40 that is contoured to match fuel pump output with the mass air flow characteristics of the engine for all engine speed and load conditions of operation so as to maintain a constant base air/fuel ratio to the mixture charge flowing into the engine combustion chamber 16 at all times. The pump has an axially movable fuel metering sleeve valve helix 42 that cooperates with a spill port 44 to block the same at times for a predetermined duration to thereby permit the output from the plunger 46 of the pump to build up a pressure against a delivery valve 48 to open the same and supply fuel to the injector 26. Axial movement of the helix by a fuel control lever 50 will vary the base fuel flow output by moving the helix to block or unblock a spill port 44 for a greater or lesser period of time.

This invention is directed to an air/fuel ratio controller that is connected to the fuel pump lever 50 to change the fuel flow output as a function of manifold vacuum changes (air flow changes) upon opening of the throttle valve 34 so that the air/fuel ratio of the mixture charge flowing to the engine cylinder will remain constant. The controller also modifies the fuel flow upon the addition of EGR gases to the intake charge and upon changes in the temperature of the intake charge, each of which again changes the oxygen concentration in the charge.

The controller is illustrated generally in FIG. 1 at 52. It contains a vacuum-mechanical linkage mechanism that is illustrated more particularly in FIGS. 2–7. The controller contains a fuel control lever 54 that is fixed to the fuel injection pump fuel lever 50 for concurrent movement. It also has a fuel flow output control link 56 that is connected to an aneroid 58 to be responsive to intake manifold vacuum changes, and a fuel enrichment linkage or fuel ratio changing linkage 60 that moves in response to the flow of EGR gases and changes in intake manifold gas temperature to modify the movement of the fuel control link 56 and fuel lever 54 to maintain the constant air/fuel ratio desired.

More specifically, FIG. 3 shows on an enlarged scale a side elevational view of the controller 52 with the side cover 70 (FIG. 2) removed for clarity. The body 72 of the controller contains a number of cavities within which is pivotally mounted a shaft 74 on which the fuel control lever 54 is fixed. Lever 54 is a right angled bellcrank, each leg 76,78 of which contains an elongated cam slot or yoke 80,82 receiving therein, respectively, floating rollers 84,86. Referring to FIG. 1, the roller 84 is received within the yoke 88 to which lever 50 is attached so that arcuate pivotal movement of leg 76 of lever 54 in either direction causes an axial movement of the helix 42 on the metering sleeve of the pump to change the fuel flow output level or rate of flow.

The floating roller 86 (FIGS. 3 and 7) is also received within the elongated slots or yokes 90,92 provided, respectively, in yoke members 94 and 96. Yoke member 94 is formed as an extension of a rod 98 fixed to the aneroid 58 movable within a sealed chamber 102. The aneroid 58 consists of an annular expandable metallic bellows that is sealed with a vacuum inside. A spring 102 biases a pair of supports 104 apart to prevent the complete collapse of the bellows from outside pressure in chamber 102. The chamber is connected by a fitting 106 to a line 108 opening into the intake manifold at 110 in FIG. 1. Thus, changes in engine intake manifold vacuum will be reflected by the contraction or expansion of the bellows 58 causing a linear movement of the rod 98 and a vertical (as seen in FIG. 3) movement of roller 86 in the slot 90 in a direction at right angles to the axis of movement of the rod 98. This causes an arcuate camming of the fuel control lever 54 by the roller 86 moving in the cam slot 82.

The other yoke member 96 in FIG. 3 is mounted for a sliding movement on a shaft 112 that is non-rotatably fixed at opposite ends in the housing 72. The yoke member 96 slides along the shaft 112 in a direction at right angles to the longitudinal axis of cam slot 92 and to the direction of movement of the floating roller 86. This movement of roller 86 again causes an arcuate movement of the fuel control lever leg 78 to rotate shaft 74 and axially move the fuel metering sleeve helix 42 shown in FIG. 1 to change the fuel output flow level or rate of flow.

It will be seen that the floating roller 86 can be moved either separately by the intake manifold vacuum changes moving rod 98, or as will hereinafter be described, by movement of the ratio changing member 96 in response to changes in the intake manifold gas temperature or the flow of EGR gases to compensate for the change in percentage of air to the total mass air flow. These movements are indicated more clearly in FIG. 3A wherein the fuel control lever 54 and two yoke members 94,96 are isolated and their movements indicated to show the mechanical advantages and linear movements providing the arcuate movement of fuel control lever 54.

FIG. 4 shows the air/fuel ratio changing mechanism that modifies the fuel output level dictated by the manifold vacuum control mechanism shown in FIG. 3 to compensate for changes in intake manifold gas temperature and the flow of EGR gases. If the density of the air changes, the weight of the air intake charge will also change and, therefore, the air/fuel ratio would change were not means provided to correct for this. Similarly, the addition or deletion of EGR gases to the mass air flow will change the oxygen concentration so that the fuel flow need be changed to maintain the air/fuel ratio constant.

Figure 3A:
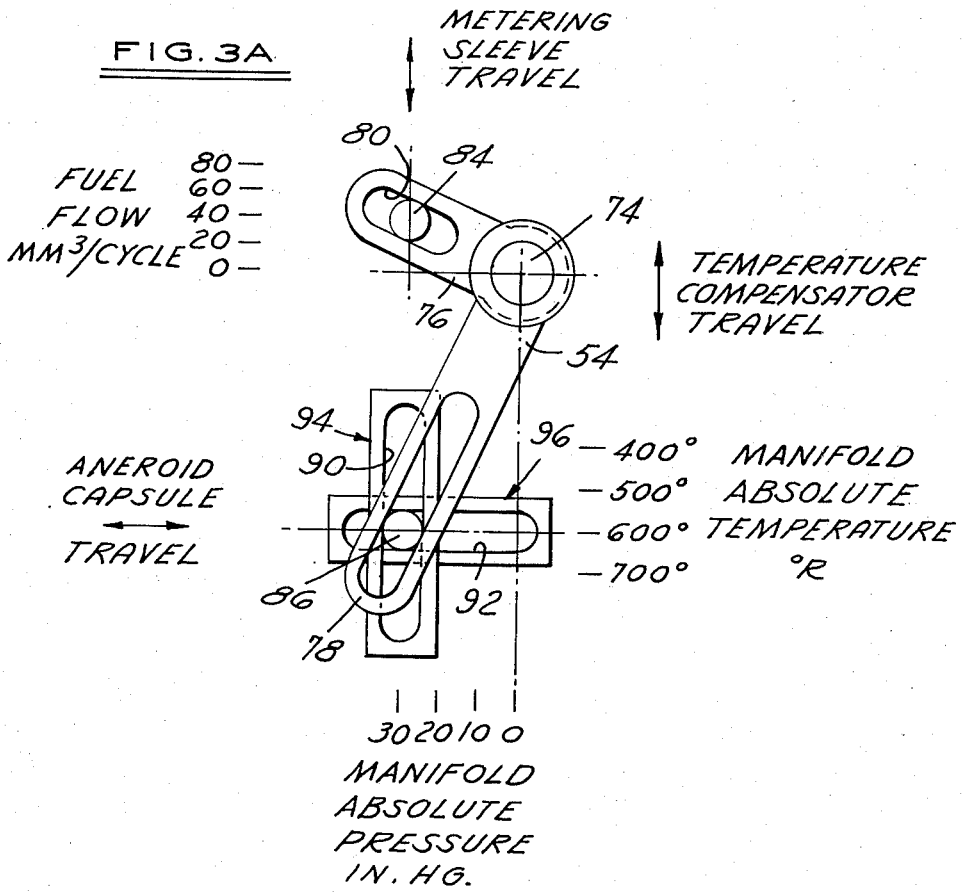
FIG. 3A is a schematic representation of the linkages shown in FIG. 3 isolated from the remaining parts, for clarity.

The yoke member 96 shown in FIG. 3 that is slidably mounted on shaft 112 has pivotally pinned to it at 114 a bellcrank lever or link 116 having an elongated cam slot or yoke 118. Slidably mounted within the slot is a floating roller 120 pivotally secured to the yoke end (FIG. 6) of a fuel enrichment lever 122. Lever 122 is pivotally mounted on a shaft 124 that is rotatably mounted in the housing 72 and, as seen in FIG. 2, extends out from the housing for attachment to an actuating lever 126. An arm 128 extends from the enrichment lever in FIG. 4 for engagement with a screw 130 adjustably mounted in the housing, for a purpose to be described later. Lever 126 in this case is connected by linkage not shown to the EGR valve 32 in FIG. 1 such that closing of the EGR valve 32 will result in a counterclockwise movement or rotation of lever 126, shaft 124 and enrichment lever 122 to pivot lever 116 in a counterclockwise direction about a pivot fulcrum 132. This will result in an upward (as seen in FIG. 5) movement of yoke member 96 and, therefore, as seen in FIG. 3, a clockwise rotation of fuel control lever 54. As best seen in FIGS. 3A and 1, this will increase the fuel flow proportional to the increased percentage of air that now displaces the EGR gas flow that has been shut off, to maintain a constant air/fuel ratio.

Conversely, a decrease in fuel flow will occur when the EGR valve is opened, to compensate for the displacement of air in the intake charge by EGR gases.

The bellcrank lever 116 is adapted to pivot about fulcrum 132 that floats in response to changes in intake manifold gas temperature. More particularly, the fulcrum 132 consists of a pin pivotally connecting one end of a link 134 to lever 116 and in turn pivotally connected to one leg of a bellcrank lever 136 rotatably mounted on a shaft 138 fixed in the housing of the controller. The opposite leg of the bellcrank slidably mounts an adjustable rod 139 having a spherical end 140. The latter provides a universal abutment with a pad end 142 of an adjustably mounted rod 144. The rod threadedly projects from within a sleeve extension 146 of an annular flexible metallic bellows 148.

The bellows 148 is sealed and filled with a liquid that has a high thermal rate of expansion. An extension 152 of the bellows anchors one end of a spring 154, the other end being secured to the bellows extension 146. A bulb 156 projects from the interior of the bellows to continuously subject the liquid in the bellows to the temperature of the intake manifold gas charge admitted into and surrounding this portion of the housing. The spring 154 maintains the bellows under compression preventing vapor formation.

FIG. 4 further shows a first spring 158 anchored to the housing and attached to a fitting 160 projecting from lever 134 to maintain the bellcrank spherical engagement portion 140 against the pad 142 of the temperature sensitive bellows extension. A second spring 166 is hooked between the housing and the fuel enrichment lever 122 to maintain the lever against the adjustable stop 130.

FIG. 5 is a side elevational view of the mechanism with the cover removed and indicates the overlying relationship of the parts in FIG. 2. In FIG. 5, a lever 170 is fixed on the fuel control lever shaft 74 for engagement with an indicator shaft 172 slidably mounted to project through the housing 72 (FIG. 2). The rod 172 forms part of a gauge 174 that indicates the fuel flow per cycle. A spring 176 lightly loads the lever 170 to eliminate some of the lash in the linkage.

In operation, as stated previously, the object of the invention is to control the movement of the fuel injection pump fuel lever 50 and the metering sleeve helix 42 to maintain the ratio of air to fuel of the intake charge flowing to the combustion chambers of the engine constant at all engine speeds and loads, and to do this by varying the fuel flow output as a function of intake manifold vacuum changes, and to modify those changes in response to changes in density of the intake manifold gas by virtue of changes in the gas temperature and by changes of volume of flow of exhaust gases upon operation of the exhaust gas recirculation system.

FIG. 3A illustrates more clearly the movement of the pump fuel metering sleeve helix (connected to 84) in response to changes in manifold vacuum and changes in intake gas temperature and the flow of EGR gases. To maintain constant intake gas to fuel ratio, the fuel flow must be directly proportional to manifold absolute pressure and inversely proportional to manifold absolute temperature. The geometry of the mechanism is such that the metering sleeve travel is directly proportional to the aneroid capsule travel and inversely proportional to the temperature compensator travel. When the throttle valve 34 is positioned closed as shown in FIG. 1, the engine will be conditioned for idle speed operation permitting only sufficient mass gas flow (air plus EGR) into the engine to maintain the desired speed level. Although not shown, an interconnection between the EGR valve and throttle valve would be provided to establish a predetermined schedule of flow of EGR gases and an opening of the EGR valve for each position of the throttle valve 34 from its closed position to a wide open throttle (WOT) position. As stated in U.S. Pat. No. 3,697,798, under WOT operating conditions, maximum power is determined by the availability of oxygen to the combustion chamber. Therefore, at WOT, no EGR flow is desired. At idle, some EGR flow may be desired and scheduled. Accordingly, since the throttle valve 34 controls the total intake through the induction passage 10, the greater the amount of EGR gas flow for the same total mass flow, the more the fuel pump lever 50 need be moved to decrease fuel flow to maintain a constant air/fuel ratio. In FIG. 3A, this is accomplished by the manifold vacuum prevalent for the particular position of the throttle valve effecting a movement of the cross slide yoke 94 linearly and at right angles to the movement of the cross slide yoke 96 whose position is attained in accordance with the volume of EGR gas flow and manifold temperature to rotate the fuel control lever 54 accordingly to predetermine the fuel flow output from the pump to maintain the constant air/fuel ratio. The aneroid movable rod 98 secured to yoke 94 will move the floating roller 86 leftwardly as seen in FIG. 3A as the manifold pressure increases upon gradual opening of the throttle valve to increase the fuel flow in proportion to the increase in air flow. If the EGR flow remains constant, no other changes will be made. However, a change in EGR flow upon opening of the throttle valve causes a corresponding movement of slide yoke 96 to further cause roller 86 to pivot the fuel control lever to change fuel flow.

It will be clear, of course, that each of the linkage mechanisms is fully adjustable so as to fine tune the movements and lengths of the linkages to provide different operating characteristics of each controller and to match each controller for different pumps having different operating characteristics and different manufacturing tolerances. For example, the geometry of the mechanism is chosen so that the theoretical zero fuel flow position of the fuel injection pump metering sleeve helix 42 is coincident with the theoretical zero manifold pressure position of the yoke 94, and the temperature scale is such that the theoretical zero absolute temperature position of the yoke 96 coincides with the center of the shaft 74 so that fuel flow will vary as a direct proportion of changes in manifold absolute pressure and inversely with changes in manifold absolute temperature. The fixed position of the fuel enrichment control lever 60 in FIG. 4 will determine the initial air/fuel ratio. This can be varied by adjustment of the screw 130 to obtain any air/fuel ratio desired.

For intake manifold gas temperature adjustments, screwing of the rod 139 in or out of the bellcrank 136 and screwing of the pad 142 into and out of the extension 146 will provide an infinite number of changes with respect to the initial settings.

One additional feature of the invention is the ability of the operator to manually enrichen the air/fuel mixture charge for maximum acceleration such as during the WOT operation. While not shown, the fuel enrichment control lever 122 in FIG. 4 would be interconnected with the EGR valve in such a manner that when the EGR valve is closed or indicates a zero EGR rate, manual rotation of the enrichment lever 122 beyond this position in a counterclockwise direction as seen in FIG. 4 will give greater fuel output.

From the foregoing, it will be seen that the invention provides a mechanism that maintains the air/fuel ratio of the intake mixture charge to the engine constant regardless of variations in the intake manifold vacuum or pressure, temperature, or EGR rate. At the same time, the driver retains the option to enrich the mixture manually whenever it is necessary for maximum acceleration.

While the invention has been illustrated and described in its preferred embodiment, it will be clear to those skilled in the arts to which it pertains that many changes and modifications may be made thereto without departing from the scope of the invention.

We claim:

1. An air/fuel ratio controller for use with the fuel injection system of an internal combustion engine of the spark ignition type having an air-gas induction passage open at one end to air at ambient pressure level and connected at its other end to the engine intake manifold to be subject to manifold vacuum changes therein, a throttle valve rotatably mounted for movement across the passage to control the air-gas flow therethrough, an exhaust gas recirculation (EGR) passage means connecting engine exhaust gases to the induction passage above the closed position of the throttle valve, an EGR flow control valve mounted in the EGR passage means for movement between open and closed positions to control the volume of EGR gas flow, and an engine speed responsive positive displacement type fuel injection pump having a fuel flow output to the engine that varies in direct proportion to changes in engine speed to match fuel flow and mass air flow through the induction system of the engine over the entire speed and load range of the engine to maintain the ratio of air to fuel constant, the fuel pump having a fuel flow control lever selectively movable in opposite directions to vary the fuel flow output per cycle, the controller characterized by, a mechanical linkage mechanism including a primary lever fixed to the pump lever for concurrent movement, an engine manifold vacuum responsive servo means, a link connecting the servo means to the primary lever for moving the primary lever and fuel lever to vary the fuel flow output as a function of changes in intake manifold vacuum indicative of changes in air flow through the induction passage to maintain the ratio of air to fuel constant, and a fuel enrichment control lever operably interconnected to the EGR valve and primary lever for modifying the movement of the primary and fuel flow levers to vary fuel flow as a function of the addition or deletion of EGR gases to the induction passage to compensate for the resulting change in percentage of air flow with respect to the total gas flow inducted to maintain a constant air/fuel ratio.

2. A controller as in claim 1, including a plurality of lost motion means operably interconnecting the primary lever and enrichment control lever and servo link providing a movement of the primary lever each time by a movement by either one alone or concurrent movement of the enrichment control lever and servo link.

3. A controller as in claim 2, the lost motion means including an elongated slot in each lever and link and a floating roller projecting through all of the slots universally connecting the levers and link.

4. A controller as in claim 3, the slots in the link and primary and fuel enrichment levers overlapping with the axis of the enrichment lever and servo link extending at right angles to each other whereby movement of one effects a movement of the roller in the other slots and rotation of the primary lever and fuel pump lever.

5. A controller as in claim 1, including a shaft mounting a second link for an axial sliding movement, the second link having an elongated slot extending at right angles to the direction of movement of the second link, the first mentioned link having an elongated slot extending at right angles to the direction of movement of the first mentioned link and overlapping the second link slot, the primary lever having an elongated slot overlapping the first mentioned link and second link slots, a roller floatingly extending through all of the slots whereby movement of either of the links alone or concurrent movement of both effects a rotation of the primary lever.

6. A controller as in claim 5, including a bellcrank operatively pivotally connected to the second link for movement thereof, and pin and elongated slot means interconnecting the bellcrank and fuel enrichment lever, the enrichment lever being arcuately movable to pivot the bellcrank to axially move the second link to adjust the position of the primary and fuel pump levers.

7. A controller as in claim 5, including temperature responsive means operably connected to the second link for adjusting the position of the primary lever as a function of temperature changes.

8. A controller as in claim 6, including intake manifold gas temperature sensitive means operably connected to the bellcrank fulcrum to move the fulcrum as a function of manifold gas temperature changes to adjust the position of the primary lever.

9. A controller as in claim 6, the enrichment lever being movable beyond a position indicative of a closed EGR valve position to move the primary lever to increase fuel flow to a lever richer than the said constant air/fuel ratio level.

10. A controller as in claim 6, including means for adjusting the position of the fulcrum of the bellcrank as a function of changes of the intake manifold gas temperature to adjust the primary lever and fuel flow to compensate for air flow density changes, the latter means including a temperature sensitive servomechanism subject to intake gas temperature conditions and contractible and expandible in response to such changes, and a second bellcrank pivotally connecting the servomechanism to the fulcrum.

11. A controller as in claim 10, the servomechanism including a thermally sensitive liquid filled bellows subject to thermal expansion and contraction.

12. A controller as in claim 10, the second bellcrank being adjustable to vary the position of the fulcrum independently of the servomechanism.

13. A controller as in claim 1, the servo means comprising a vacuum sealed aneroid capsule subjected to manifold absolute pressure effecting a contraction and expansion of the aneroid upon changes in manifold vacuum, and a rod connecting the aneroid to the primary lever.

14. A controller as in claim 6, including stop means and spring means biasing the enrichment lever to an initial air/fuel ratio determining position against the stop means, the stop means being adjustable to vary the initial air/fuel ratio setting.

15. An air/fuel ratio controller for use with the fuel injection control system of an internal combustion engine of the spark ignition type having a gas induction passage open at one end to air at ambient pressure level and connected at its other end to the engine combustion chamber to be subject to manifold vacuum changes therein, a throttle valve rotatably mounted for movement across the passage to control the gas flow therethrough, exhaust gas recirculation (EGR) passage means connecting the engine exhaust gases to the induction passage above the closed position of the throttle valve, and EGR flow control valve mounted in the EGR passage means for movement between open and closed positions to control the volume of EGR gas flow, an engine speed responsive positive displacement type fuel injection pump having a fuel flow output to the engine that varies in direct proportion to changes in engine speed to match fuel flow and mass air flow through the induction system of the engine over the entire speed and load range of the engine to maintain the intake mixture ratio of air to fuel constant, the controller being characterized by regulator means including servo operated means responsive to changes in manifold vacuum for changing the pump output fuel flow, the regulator means also being independently responsive both to changes in density of the intake gas and to the flow level of EGR gases to modify the manifold vacuum force acting to adjust the fuel pump output to compensate for the resultant change in the percentage of air flow with respect to the total gas flow through the induction passages per cycle to maintain the ratio of air to fuel constant.

16. A controller as in claim 15, wherein the regulator means includes temperature sensitive means responsive to the temperature of the gas in the intake manifold passage for adjusting the fuel output from the pump.

17. A controller as in claim 15, the fuel pump having a lever movable in opposite directions to vary the fuel output flow rate, the regulator including a mechanical linkage having a fixed connection to the fuel pump lever, and a manifold vacuum controlled servo connected to the fixed connection and lever for moving the lever in response to changes in manifold vacuum.

18. A controller as in claim 15, the regulator means including means responsive to manifold vacuum changes indicative of changes in mass air flow and EGR gas flow upon opening of the throttle valve to vary the fuel output to maintain the air to fuel ratio constant.

19. A controller as in claim 17, the regulator including a second servo sensitive to intake manifold gas temperature and operably connected to the fuel pump lever for adjusting the pump fuel flow as a function of manifold gas temperature changes.

20. A controller as in claim 15, the pump having a fuel flow control lever movable to change fuel flow and connected to the regulator means, and further means interconnecting the EGR valve and regulator means whereby change in flow of EGR gases effects a movement of the regulator means and fuel pump lever.

21. A controller as in claim 17, the regulator including means for varying the position of the fuel pump lever to a position providing an air/fuel ratio other than the constant air-gas/fuel ratio in response to accelerating conditions of operation of the engine.

22. A controller as in claim 15, the fuel pump having a lever movable to vary the fuel pump output flow rate from a base setting, the regulator means including a first servo responsive to manifold vacuum changes and operably connected to the fuel pump lever for changing fuel flow output as a function of manifold vacuum changes upon opening of the throttle valve, the regulator means including second servo means operably connected to the pump lever responsive to temperature changes of the intake manifold gas flow for changing fuel flow, and other means including means operably interconnecting the EGR valve and the regulator means and the pump lever for moving the pump lever to vary the fuel output as a function of changes in the position of the EGR valve.

23. A controller as in claim 22, the other means including a second lever fixed for movement with the pump lever and connected to the first servo means, the other means including a fuel enrichment control lever connected to the second lever by lost motion pin and slot type connections and also connected to the EGR valve.

* * * * *